US006661987B2

(12) United States Patent
Hiroki

(10) Patent No.: US 6,661,987 B2
(45) Date of Patent: Dec. 9, 2003

(54) IMAGE FORMING APPARATUS FOR FORMING COLOR IMAGES

(75) Inventor: Masashi Hiroki, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/055,015

(22) Filed: Jan. 25, 2002

(65) Prior Publication Data

US 2003/0142996 A1 Jul. 31, 2003

(51) Int. Cl.[7] ..... G03G 15/01

(52) U.S. Cl. ..... 399/227; 399/302

(58) Field of Search ..... 399/226–228, 399/298, 302

(56) References Cited

U.S. PATENT DOCUMENTS 6,327,449 B1 * 12/2001 Matsuzaki ..... 399/227

* cited by examiner

*Primary Examiner*—William J. Royer
(74) *Attorney, Agent, or Firm*—Foley & Lardner

(57) ABSTRACT

In an image forming apparatus, developing rollers of plural color developing units having respective color developers are arranged at an equal space of a first distance along a circumference in contact with an image carrier separately from a black developing unit and on the other hand, the developing rollers from the last part in the revolving direction of a revolving body to the foremost part in the revolving direction are arranged at a space of a second distance that is longer than the first distance, a revolving-type developing device to supply a color developer to the image carrier by bringing anyone of plural color developing units to oppose to the image carrier, and for the developing roller at the last part in the revolving direction to the developing roller at the foremost part separated by the second distance, a black developer is supplied to the image carrier by the black developing unit.

19 Claims, 10 Drawing Sheets

IMAGE FORMING APPARATUS FOR FORMING COLOR IMAGES

BACKGROUND OF THE INVENTION

1. Field of the Invention

This invention relates to such image forming apparatus as electrophotographic apparatus, printers, and the like to obtain color developer images using a revolver type-developing unit.

2. Description of the Related Art

The image forming apparatus produces a full-color image using 4 color toners of yellow (Y), magenta (M), cyan (C) and black (BK). In this image forming apparatus, a photoconductor is rotated by plural turns and latent images in respective colors are formed successively on the photoconductor for every turn. After forming the latent images on the photoconductor, these latent images are made visible by supplying toners in different colors to the photoconductor by plural developing units and the formed toner images are superposed on each other on the photoconductor or an intermediate transfer body. Thus, the image forming apparatus is made small in size.

As developing units to supply toners in different colors successively to latent images formed on a photoconductor for every turn of the photoconductor, a 4-color revolver type developing unit for developing latent images on the photoconductor by arranging developing units opposing to the photoconductor for supplying developers in specified colors successively by revolving a single revolving holder equipped with four developing units having four color toners of yellow (Y), magenta (M), cyan (C) and black (BK) is disclosed in Japanese Patent Publication No. 2001-24952. However, this 4-color revolver type developing unit is small in size but sizes of developing units that are incorporated in a revolving-type holder are limited. Therefore, a black developing unit to supply black (BK) toner only consumes much black toner fast and replenishment of black toner or exchange of a black developing unit is frequently demanded.

Therefore, an apparatus equipped with three developing units only to supply three colors of yellow (Y), magenta (M) and cyan (C), and a large capacity black developing unit for supplying much consuming black (BK) toner arranged separately from a revolver type developing unit for extending the life of the black developing unit is disclosed in Japanese Patent Publication No. 6-19271.

However, in the case of this 3-color revolver type developing unit equipped with 3-color developing units of yellow (Y), magenta (M) and cyan (C) only and a black developing unit provided separately, 3-color developing units 1Y, 1M, and 1C for supplying yellow (Y), magenta (M) and cyan (C) are arranged at an angle 120° to a revolving shaft 1*a* of the 3-color revolver type developing unit as shown in FIG. 1. That is, in this 3-color revolver type developing unit 1, to switch the yellow (Y) developing unit 1Y to the next magenta (M) developing unit 1M after completing the yellow toner image development, it is necessary to revolve the 3-color revolver type developing unit 1 by 120°.

In the case of a 4-color revolver type developing unit 2 shown in FIG. 2, four color developing units of yellow 2Y, magenta 2M, cyan 2C and black 2BK are arranged at an angle 90° to the revolving shaft 2*a*. Therefore, the developing units can be switched by revolving the 4-color revolver type developing unit 2 only by 90° but the 3-color revolver type developing unit 1 requires 4/3 times of revolving amount.

For this reason, when the printing velocity of the 3-color revolver type developing unit 1 is made at least the same as that of the 4-color revolver type developing unit 2, it is necessary to revolve the 3-color revolver type developing unit at a higher speed of 4/3 times than the revolving speed of the 4-color revolver type developing unit 2.

Moreover, the further high-speed process is demanded in recent years for the increase in the number of image forming sheets per unit time resulting from the pursuit of high productivity of an image forming apparatus. This high productivity of the number of image forming sheets is achieved by increasing the processing speed and decreasing the supply interval of recording paper during the image forming process. In order to reduce the supply interval of recording paper, a switching time of developing units is more and more reduced, and the more increase of revolving velocity in switching the developing units is demanded for the revolver type developing unit.

For such the increase of switching velocity of the developing units, a driving motor and a power source for revolving the revolver type developing unit become large and the development of small-sized and energy saving image forming apparatus is impeded and further, vibration is generated when the revolver type developing unit is stopped after the high-speed revolving, and this vibration may possibly adversely affect images.

Accordingly, in an image forming apparatus to obtain color developed images using a revolver type developing unit, it is expected to develop a small-sized driving motor and a power source for a revolver type developing unit to realize the high-speed development without impeding the maintenance or the long life of a black developing unit and to obtain images of good quality without being adversely affected by vibration when stopping the revolver type developing unit.

SUMMARY OF THE INVENTION

An object of this invention is to provide an image forming apparatus with a driving motor and a power source small in size without impeding the high-speed image forming process by a revolver type developing unit with a black developing unit arranged separately, capable of revolving in a short time and obtaining good images without generating vibration.

According to the embodiment of this invention, an image forming apparatus is provided. This image forming apparatus comprises an image carrier; a latent image forming unit to form latent images on the image carrier; a black developing unit arranged near the image carrier to supply a black developer to the image carrier; and a revolving-type developing unit. This revolving-type developing unit is arranged at a position near the image carrier and differing from the black developing unit, comprising developing units of plural color developing units which have different color developers arranged at equal space of a first distance along the circumference of a revolving body in contact with the image carrier. On the other hand, the developing unit at the last part in the revolving direction of the revolving body to the developing unit at the foremost part in the revolving direction are separated at a second distance that is longer than the first distance, and anyone of the plural color developing units is arranged opposing to the image carrier and supplies a color developer, and it is characterized in that for the area from the developing unit at the last part of the revolving-type developing unit to the foremost developing unit separated by the second distance opposing to the image carrier, a black developer is supplied to the image carrier by the black developing unit.

Further, according to the embodiment of this invention, an image forming apparatus is provided. This image forming apparatus comprises an image carrier; a latent image forming unit to form latent images on the image carrier; a black developing unit arranged near the image carrier to supply a black developer to the image carrier; and a revolver type developing unit arranged at a position differing from the black developing unit. This revolver type developing unit is composed of plural color developing units having different color developers, and developing rollers of these plural color developing units are arranged along the circumference of a revolving holder in contact with the image carrier at an equal space of the first distance and on the other hand, those developing rollers from the roller at the last part in the the revolving direction of the revolving body to the roller at the foremost part in the revolving direction are separated at a second distance that is longer than the first distance, and one of the plural color developing units is arranged opposing to the image carrier sequentially and supplies a color developer to the image carrier, and it is characterized in that the area ranging from the developing roller at the last part of the revolving-type developing unit to the foremost developing roller separated by the second distance opposing to the image carrier, a black developer is supplied to the image carrier by the black developing unit.

DETAILED DESCRIPTION OF THE INVENTION

Figure 1:
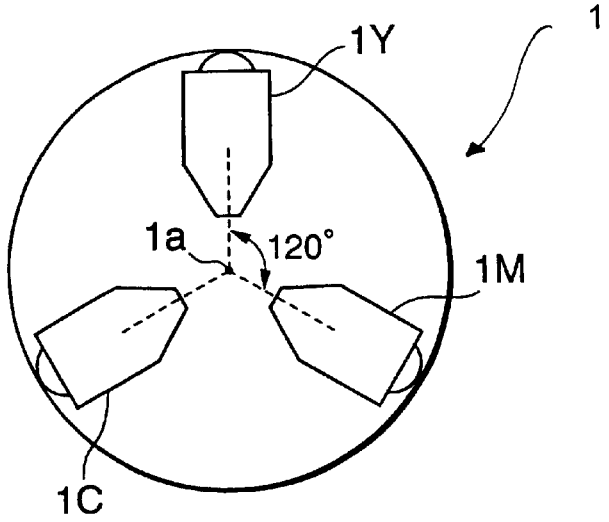
FIG.1 (PRIOR ART)
FIG. 1 is a schematic diagram showing the structure of a conventional 4-color revolver type developing unit.
Figure 2:
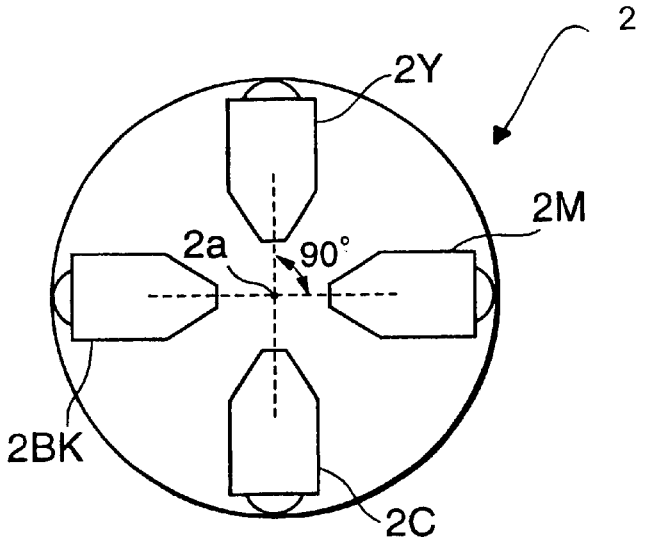
FIG.2 (PRIOR ART)
FIG. 2 is a schematic diagram showing the structure of a conventional 3-color revolver type developing unit.
Figure 3:
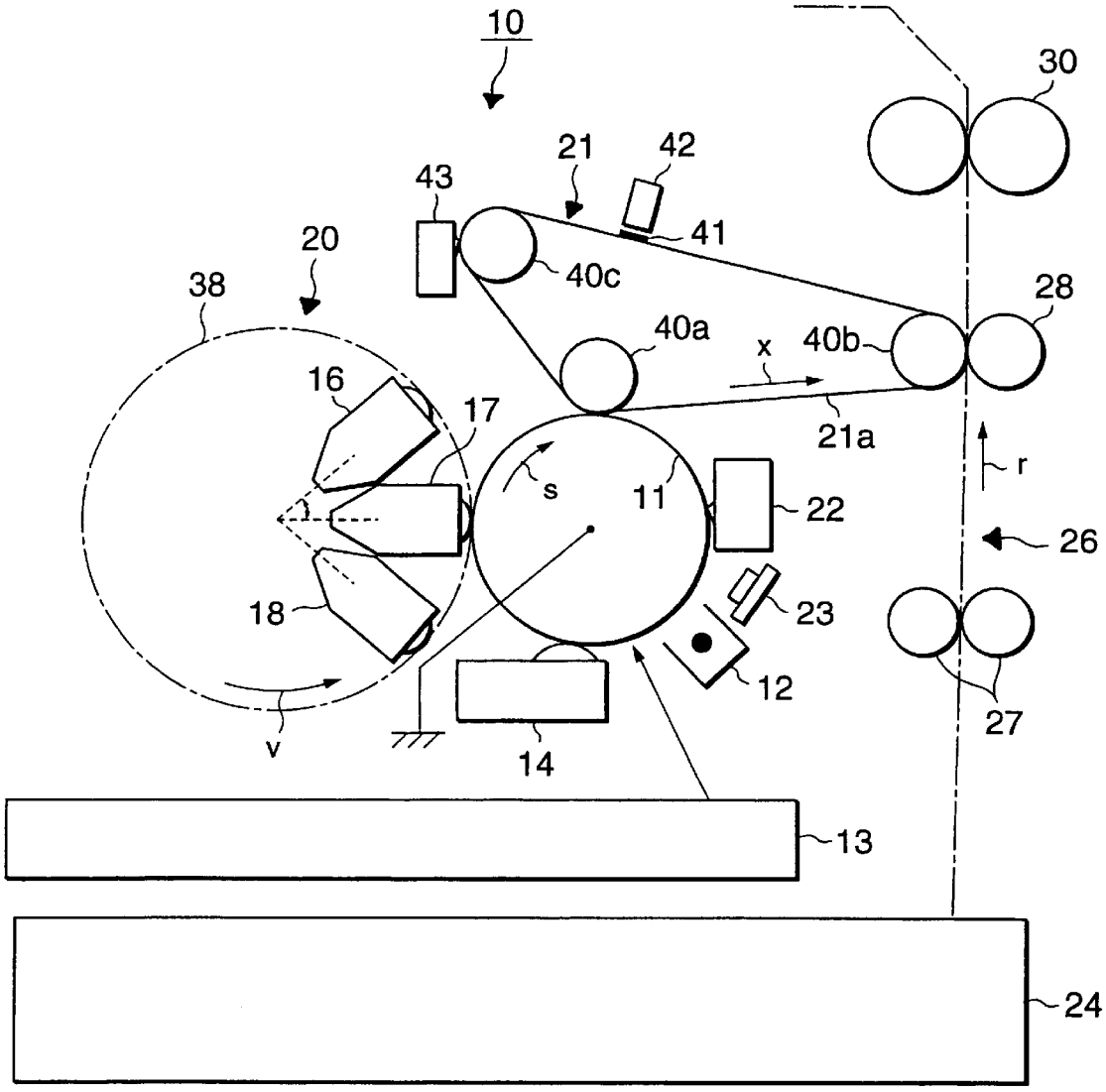
FIG. 3 is a schematic diagram showing an image-forming unit in an embodiment of this invention.

A preferred embodiment of this invention will be described below in detail referring to the attached drawings. FIG. 3 is a schematic diagram showing the structure of an image forming unit 10 of an image forming apparatus such as color printers that is an embodiment of this invention. Around a photosensitive drum 11 which is an image carrier of the image forming unit 10 and the back of its photosensitive layer (not shown) is grounded to 0 [V] (GND), there are arranged a charger 12 which uniformly charges the photosensitive drum 11 to about −700 [V] gradually in the revolving allow direction s, a laser writing unit 13 which is a latent image forming unit for forming latent images on the charged photosensitive drum 11, a black developing unit 14 which is a black developing device having black (BK) toner, a 3-color revolver type developing unit 20 which is a revolving type developing device equipped with a first through third developing units 16–18 which are color developing devices having three color developers; yellow (Y), magenta (M) and cyan (C) three color toners; an intermediate transfer device 21 having an intermediate transfer belt 21*a*, a cleaner 22, and a change eliminating lamp 23.

Below the image forming unit 10, there are provided a paper cassette 24 to house recording paper (not shown) that is transfer material, an aligning roller pair 27 to bring the leading edge of a recording paper taken out from the paper cassette 24 and conveyed along a conveying path 26 to synchronize with the leading edge of a toner image transferred on the intermediate transfer belt 21*a*, a secondary transfer roller 28 to which +1–2 [kV] bias voltage is applied for secondarily transferring a toner image from the intermediate transfer belt 21*a* on a recording paper, and a fixing roller pair 30 to fix a toner image on a recording paper. Further, the speed of the image forming process in this image forming unit 10 is 180 [mm/sec].

The laser writing unit 13 forms an electrostatic latent image on the photosensitive drum 11 by applying a laser beam corresponding to writing signals for all colors according to image data input from external computer terminals.

The black developing unit 14 is capable of revolving centering around a supporting point 14*b*. A developing roller 14*a* is revolved in the arrow direction t1 or t2 when a cam 32 is revolved centering around a shaft 32*a* and contacts or separates from the photosensitive drum 11. 33 is a mark for stopping the revolution of the cam 32, and 34 is a sensor to detect this mark 33. A toner is supplied to the black developing unit 14 by a black (BK) toner cartridge that is not shown.

The first through third developing units 16–18 have first through third non-magnetic one-component type developing cartridges 16*b*–18*b* and first through third toner cartridges 16*c*–18*c* which supply yellow (Y), magenta (M), and cyan (C) toners to the first through third developing cartridges 16*b*–18*b*, respectively. The first through third developing cartridges 16*b*–18*b* and the first through third toner cartridges 16*c*–18*c* are connected to each other with first through third pipes 16*d*–18*d*.

The 3-color revolver type developing unit 20 has a revolving holder 37 which is revolved centering around a revolving shaft 36 at a peripheral velocity 180–200 [mm/sec] by a driving motor (not shown). The revolving holder 37 revolves at an angle of 30° to the revolving shaft 36 between the first and second developing cartridges 16*b* and 17*b* and the second and third developing cartridges 17*b* and 18*b*, and supports the first through third developing units 16–18 so that an angle to the revolving shaft 36 becomes 300° between the third and first developing cartridges 18*b* and 16*b*. Thus, first through third developing rollers 16*a*–18*a* are arranged centering around the revolving shaft 36 of the circumference 38 in a diameter 180 [mm] in contact with the photosensitive drum 11 in the arrow direction v at equal space 47.1 [mm]=L1 that is a first distance. On the other hand, the developing rollers 16*a*–18*a* from the last third developing roller 18*a* to the front developing roller 16*a* in the arrow direction v are arranged at equal distance 471.2 [mm]=L2 that is longer than L1.

Further, the first through third toner cartridges 16*c*–18*c* of the first through third developing units 16–18 are arranged centering around the revolving shaft 36 symmetrically with the first through the third developing cartridges 16*b*–18*b*.

In FIGS. 7–10, 46 is a mark for stopping the rotation formed on the revolving holder 37 and 47 is a holder sensor to detect the mark 46. When the 3-color revolver type developing unit 20 stops at the position where this mark 46 is detected by the holder sensor 47, the first developing cartridge 16*b* stops at the position opposing to the photosensitive drum 11, that is the developing position. Hereafter, the revolving holder 37 is revolved successively for a specified time in the arrow direction v and the second and third developing cartridges 17*b* and 18*b* are arranged to face the photosensitive drum 11.

Thus, yellow (Y), magenta (M) and cyan (C) toners are supplied to the photosensitive drum 11 in order by the first through third developing rollers 16*a*–18*a*. Further, when the revolution of the 3-color revolver type developing unit 20 is revolved in the arrow direction v after completing the development by the third developing roller 18*a*, the black developing unit 14 develops images on the photosensitive drum 11 as long as the area from the third developing roller 18*a* to the first developing cartridge 16*b* faces the photosensitive drum 11.

A length Lb of the intermediate transfer belt 21*a* of the intermediate transfer device 21 is (216+51)×2=534 [mm]) so that an image requiring 2 sheets of letter size paper (216×279 [mm]) is formed at a space 51 [mm] between recording sheets of paper and the intermediate transfer belt 21*a* is put over a primary transfer roller 40*a* to which +1 [kV] transfer bias is applied, an opposed secondary transfer roller 40*b* that is grounded at 0 [V], and a tension roller 40*c*. On the intermediate transfer belt 21*a*, an exposure start mark 41 for positioning when image patterns in different colors are put over each other and a sensor 42 for detecting the exposure start mark 41 is provided near the intermediate transfer belt 21*a*. Further, 43 is a belt cleaner.

The intermediate transfer belt 21*a* contacts the photosensitive drum 11 at the position where it is supported by the primary transfer roller 40*a* and a toner image formed on the photosensitive drum 11 is transferred primarily, and is opposed to the secondary transfer roller 28 at the position where it is supported by the opposed secondary transfer roller 40*b* and transfers the toner image secondarily on a recording paper passing between the secondary transfer roller 28 and the opposed secondary transfer roller 40*b*.

Figure 7:
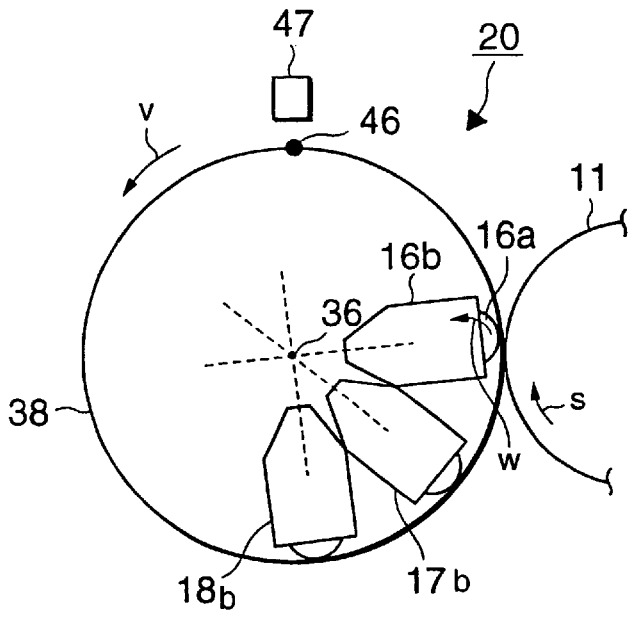
FIG. 7 is a schematic diagram for explaining the state of the development by a first 3-color revolver type developing unit in an embodiment of this invention.

Next, the full-color image forming process by the image forming unit 10 will be described. In this image forming unit 10, a full-color image is formed by superposing yellow (Y), magenta (M), cyan (C) and black (BK) toner images over each other in that order. When image forming is started, the 3-color revolver type developing unit 20 is stopped at a position where the holder sensor 47 detects the mark 46 as shown in FIG. 7. Then, the first developing cartridge 16*b* having yellow (Y) toner is arranged at the developing position opposite to the photosensitive drum 11. The first developing roller 16*a* contacts the photosensitive drum 11 at this position.

Figure 5:
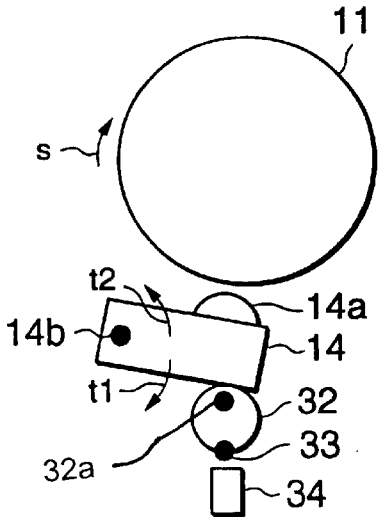
FIG. 5 is a schematic diagram for explaining the state of the black developing unit separated from the photosensitive drum in the embodiment of this invention.

At this time, as the cam 32 is kept stopped at the position where the sensor 34 detected the mark 33 as shown in FIG. 5, the developing roller 14*a* of the black developing unit 14 was revolved centering around the supporting point 14*b* in the arrow direction t1 by its dead weight and the developing roller 14*a* is separated from the photosensitive drum 11.

Figure 11:
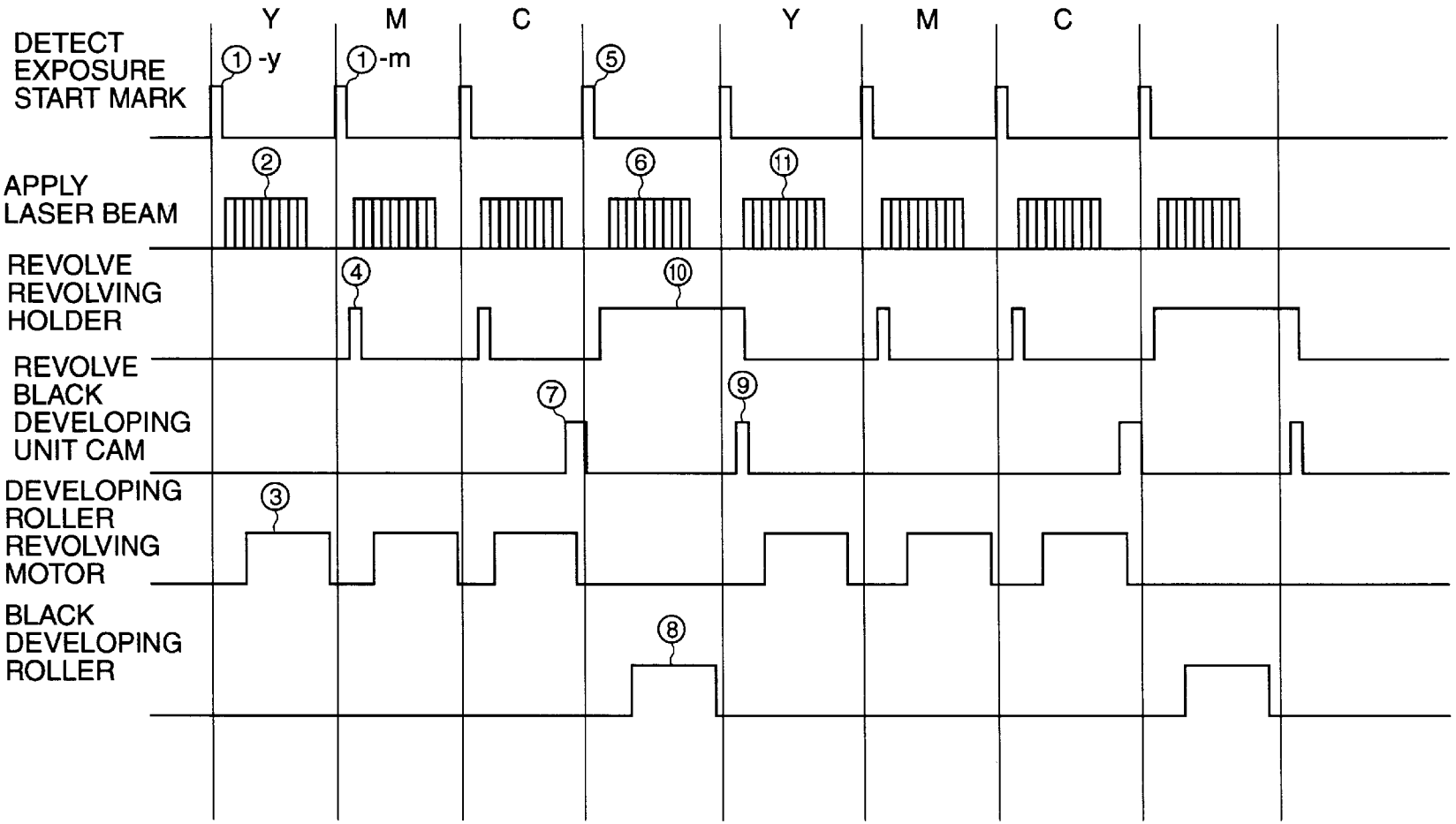
FIG. 11 is a timing chart showing the developing process in an embodiment of this invention.

When an image forming process starts under such a state, the photosensitive drum 11 is revolved in the arrow direction s at the velocity of 180 [mm/sec] and uniformly charged to −700 [V] by the charger 12 with its revolution. Hereafter, the electrostatic latent image forming and the developing image forming are executed at the timings shown in the timing chart in FIG. 11. That is, when the sensor 42 detects the passage of the exposure start mark 41 on the intermediate transfer belt 21*a* at the timing (1)–y,the laser beam corresponding to the yellow image signal out of separated yellow, magenta, cyan and black signals is applied to the photosensitive drum 11 by the laser writing unit 13 at the timing (2). Thus, an yellow electrostatic latent image of about −100 [V] of the laser beam applied part is formed on the photosensitive drum 11. Hereafter, the photosensitive drum 11 reaches the 3-color revolver type developing unit 20.

In the 3-color revolver type developing unit 20, the first developing roller 16*a* is revolved in the arrow direction w by a developing roller revolving motor (not shown) as shown by the timing (3) in consonance with the arrival of the yellow electrostatic latent image as shown by the timing (3). Bias voltage −300 V or AC when necessary is applied to the first developing roller 16*a* and the yellow toner of the yellow toner image on the photosensitive drum 11 is electrostatically transferred while it passes through the nip between the photosensitive drum 11 and the first developing roller 16*a* and an yellow (Y) toner image is formed.

Then, when the toner image on the photosensitive drum 11 reaches the position to contact the intermediate transfer belt 21*a* that is revolved in the arrow direction x, the yellow toner image is primarily transferred on the intermediate transfer belt 21*a* by the transfer bias of about +1 [kV] applied to the primary transfer roller 40*a*. After the primarily transfer, residual toner remained on the photosensitive drum 11 is cleaned and the surface charge is eliminated by the charge eliminating lamp 23.

Hereafter, the magenta, cyan and black toner image forming processes are repeated to the photosensitive drum 11 successively likewise the yellow toner image forming process described above, and by transferring the yellow (Y), magenta (M), cyan (C) and black (BK) toner images successively on the intermediate transfer belt 21*a* from the photosensitive drum 11, a full-color toner image with 4 color toner images put over each other is formed on the intermediate transfer belt 21*a*.

Figure 8:
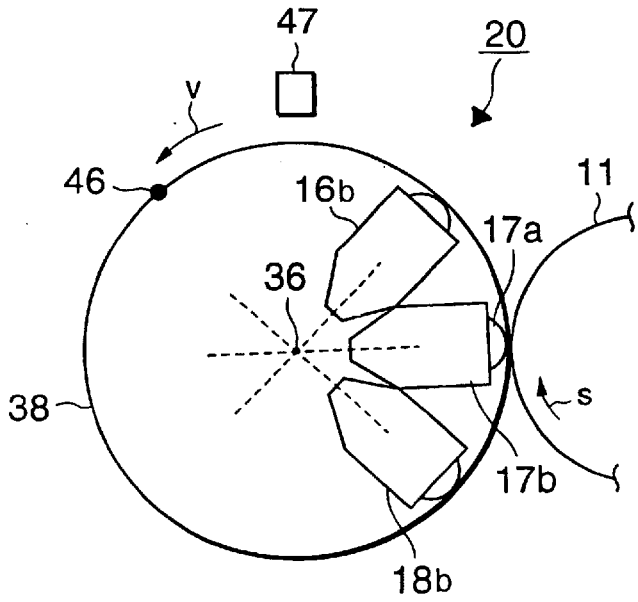
FIG. 8 is a schematic diagram for explaining the state of the development by a second 3-color revolver type developing unit in an embodiment of this invention.

During this period, in the 3-color revolver type developing unit 20, when the trailing edge of the yellow electrostatic latent image passed and the yellow toner image development is completed, the first developing roller 16*a* is stopped to revolve and the first developing cartridge 16*b* at the developing position is switched to the second developing cartridge 17*b* until the leading edge of the next magenta electrostatic latent image arrives as shown by the timing (4) and therefore, the second developing cartridge 17*b* is moved to a developing position facing to the photosensitive drum 11. That is, as shown in FIG. 8, the revolving holder 37 is revolved in the arrow direction v for a specified 0.262 [sec] at a mean moving velocity 180 [mm/sec] so as to move for the distance L1 on the circumference 38 from the position where the holder sensor 47 detects the mark 46. The second developing cartridge 17*b* reaches the developing position and the second developing roller 17*a* contacts the photosensitive drum 11 and the development by the magenta toner becomes possible.

Then, when the sensor 42 detects the passing of the exposure start mark 41 by the intermediate transfer belt 21*a* at the timing (1)–m, a magenta electrostatic latent image is formed on the photosensitive drum 11 by the laser writing unit 13. Thereafter, the electrostatic latent image on the photosensitive drum 11 is developed by a magenta (M) toner while passing the nip between the second developing roller 17*a* to which a bias voltage is applied and revolved in the arrow direction w and a magenta toner image is formed on the photosensitive drum 11.

Figure 9:
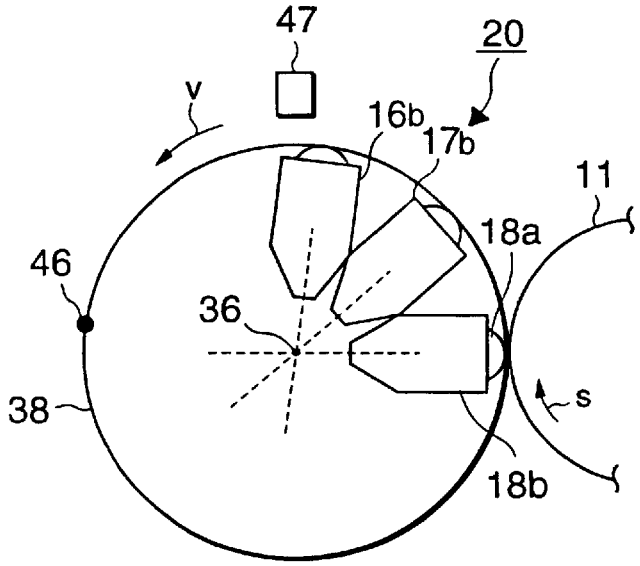
FIG. 9 is a schematic diagram for explaining the state of the development by a third 3-color revolver type developing unit in an embodiment of this invention.

Hereafter, when the trailing edge of the magenta electrostatic latent image passed and the development of the magenta toner image is completed, the 3-color revolver type developing unit 20 switches the second developing cartridge 17*b* to the third developing cartridge 18*b* before the leading edge of a next cyan electrostatic latent image reaches the developing position likewise the switching from the first developing cartridge 16*b* to the second developing cartridge 16*b*. That is, the revolving holder 37 is revolved for a specified 0.262 sec. in the arrow direction v at a mean moving velocity 180 [mm/sec] so as to further move for a distance L1 on the circumference 38 as shown in FIG. 9. Thus, the third developing roller 18*a* contacts the photosensitive drum 11 and the development by a cyan (c) toner becomes possible.

Then, when the cyan electrostatic latent image formed on the photosensitive drum 11 passes the nip with the third developing roller 18*a*, the electrostatic latent image is developed with a cyan (c) toner and a cyan toner image is formed on the photosensitive drum 11.

Figure 10:
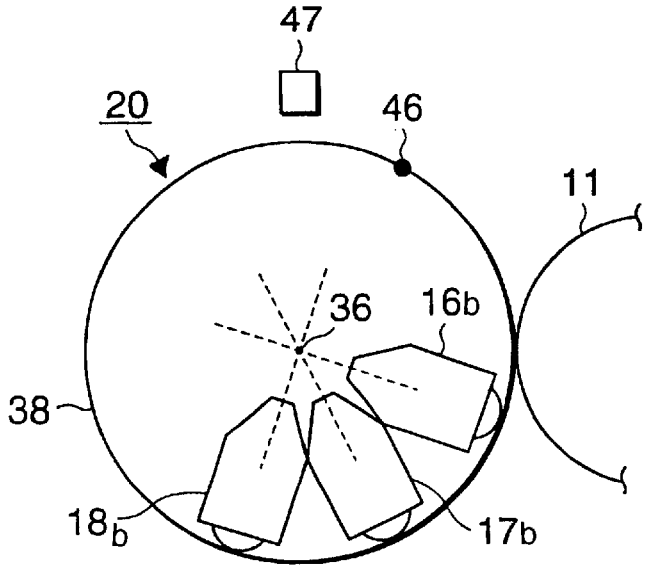
FIG. 10 is a schematic diagram for explaining the ready state of the 3-color revolver type developer unit in an embodiment of this invention.

Hereafter, when the trailing edge of the cyan electrostatic latent image passes the developing position and the cyan toner image development is completed, the 3-color revolver type developing unit 20 revolves the revolving holder 37 in the arrow direction v at a mean moving velocity 180 [mm/sec] at the timing (10). Then, when the image forming process is executed successively, the revolving holder 37 is stopped at a position where the holder sensor 47 detects the mark 46 as shown in FIG. 7. On the other hand, when there is no succeeding image forming process, after revolving the revolving holder 37 for a specified time and stopping it, the 3-color revolver type developing unit 20 becomes the ready state as shown in FIG. 10.

At this time, by decelerating the moving velocity of the revolving holder 37, the first developing unit 16 having a yellow (Y) toner is prevented from reaching the developing position before completing the developing by the black developing unit 14 as described later and disturbing a black toner image formed on the photosensitive drum 11 during the successive image forming processes.

Figure 4:
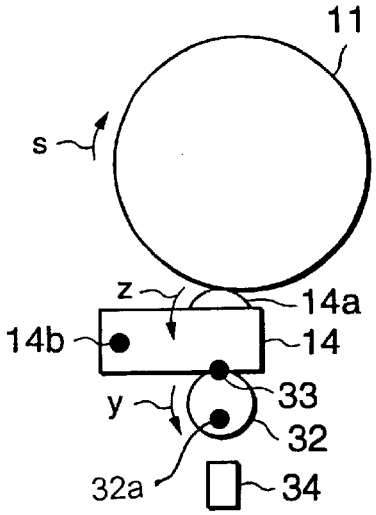
FIG. 4 is a schematic diagram for explaining the state of a black developing unit in contact with a photosensitive drum.

On the other hand, when the trailing edge of a cyan electrostatic latent image passes the developing position of the black developing unit 14, the cam 32 of the black developing unit 14 revolves in the arrow direction y for a specified time as shown by the timing (7). Then, the developing roller 14*a* of the black developing unit 14 is pushed up in the arrow direction t2 and contacts the photosensitive drum 11 as shown in FIG. 4, and the development becomes possible.

Then, when the passing of the exposure start mark 41 of the intermediate transfer belt 21*a* is detected by the sensor 42 as shown by the timing (5), a black electrostatic latent image is formed on the photosensitive drum 11 by the laser writing unit 13 at the timing (6). Then, the black electrostatic latent image is developed while passing through the nip with the developing roller 14*a* that is applied with a bias voltage and revolved in the arrow direction z, and a black toner image is formed on the photosensitive drum 11.

When the trailing edge of the black electrostatic latent image passes and the black toner development is completed, in the black developing unit 14, the developing roller 14*a* stops to revolve, the cam 32 is revolved again in the arrow direction y as shown by the timing (9) and stops at the position where the sensor 34 detects the mark 33 and the developing roller 14*a* is separated from the photosensitive drum 11.

Thereafter, when the image forming process is executed successively, the revolution of the revolving holder 37 started at the timing (10) continuous as long as the development is made by the black developing unit 14, and the revolving holder 37 stops to revolve when the mark 46 is detected by the holder sensor 47 and the first developing cartridge 16*b* is arranged at the developing position. Thereafter, when the exposure start mark 41 is detected by the sensor 42 at the intermediate transfer belt 21*a*, the laser beam corresponding to the yellow image signal is applied to the photosensitive drum 11 by the laser wiring unit 13 in order to form a full-color image on a second sheet as shown by the timing (11).

Hereafter, the similar operations are repeated and toner images formed on the photosensitive drum 11 are intermediately transferred on the intermediate transfer belt 21*a* successively. That is, while the development is being executed by the black developing unit 14, the 3-color revolver type developing unit 20 moves for the distance L2, the first developing cartridge 16*b* is moved to the developing position for the third developing cartridge 18*b* and the next continuous image forming process becomes ready.

On the other hand, yellow (Y), magenta (M), cyan (C) and black (BK) full-color toner images superposed on the intermediate transfer belt 21*a* are collectively transferred on a recording paper by the electric field formed at the position of the secondary transfer roller 28 by the secondary transfer roller 28 to which +1–2 [kV] bias voltage is applied and the opposing secondary transfer roller 40*b* which is grounded to 0 [V]. Further, a recording paper is taken out in the arrow direction r from the paper cassette 24 and conveyed to the position of the secondary transfer roller 28 synchronizing with the full-color image. Thereafter, the full-color toner image is fixed on the recording paper by the fixing roller pair 30 and a color image is completed. On the other hand, after completing the transfer on a recording paper, residual toners remained on the intermediate transfer belt 21*a* arw cleaned by the belt cleaner 43.

Figure 6:
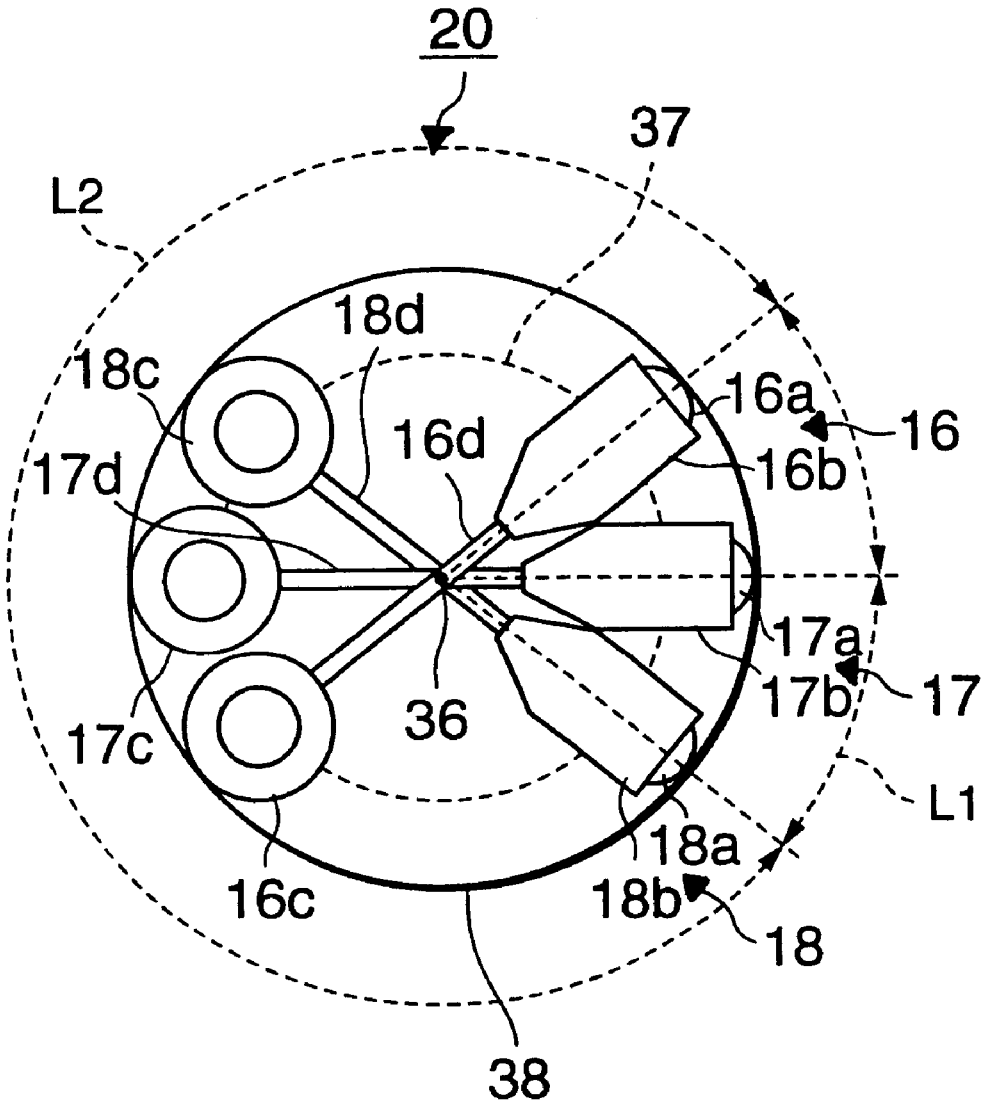
FIG. 6 is a schematic diagram showing a 3-color revolver type developing unit in an embodiment of this invention.

According to this embodiment, the first through third developing units 16–18 are adjacent to the revolving shaft 36 at an angle 30° and arranged in a space as short as L=47.1 [mm] on the circumference 38 as shown in FIG. 6. Therefore, a switching time of the developing units 16–18 can be made short even when not revolving the 3-color revolver type developing unit 20 at a high speed, and the developing units 16–18 can be switched before a next electrostatic latent image reaches the developing position after a preceding electrostatic latent image is developed. Further, the third developing unit 18 can be switched to the first developing unit 16 when the development is being made by the black developing unit 14 and therefore, even when a distance set between the third developing unit 18 and the first developing unit 16 is as long as L2=471.2 [mm], the switching can be sufficiently made before starting the next development by the first developing unit 16 even when the 3-color revolver type developing unit 20 is not revolved at a high speed.

Accordingly, it is not needed to use a large power source to supply electric power to a large torque driving motor or ordinary driving motor for revolving the 3-color revolver type developing unit 20 with a separately provided black developing unit 14, and a small sized and energy saving type image forming apparatus capable of extending the life of the black developing unit 14 without impeding a high speed image forming processing property can be obtained. Furthermore, as it is not needed to revolve the 3-color revolver type developing unit 20 at a higher speed, it is possible to reduce the vibration of the 3-color revolver type developing unit generated when it stops to revolve, prevent adverse effects of the vibration to images and obtain a color image of good quality.

Further, the first through third developing units 16–18 are so arranged that the first through third toner cartridges 16*c*–18*c* and the first through third developing toner cartridges 16*b*–18*b* become symmetrical centering around the revolving shaft 36 and therefore, the first through third developing units 16–18 can be formed in the same structure except the pipes 16*d*–18*d* and manufacturing costs can be reduced by manufacturing commonly usable component parts.

Further, this invention is not limited to the embodiment described above but can be modified variously within the spirit and scope thereof. For example, the first distance or the second distance between the developing units in a revolving type developing device is not limited; for example, the first distance cannot be made extremely short because of the restriction of a size of the developing device but a switching time of the developing devices can be further shortened and it becomes possible to achieve the higher speed of the image forming process without revolving a revolving type developing device at high speeds.

Further, the timing for revolving the rotary type-developing device is also optional. In the above embodiment, the revolving velocity of the 3-color revolver type developing unit 20 is slow so as to prevent a black toner image on the photosensitive drum 11 from being disturbed by contact with the first developing roller 16*a*. However, another method not to carry out such velocity control may be used.

Figure 12:
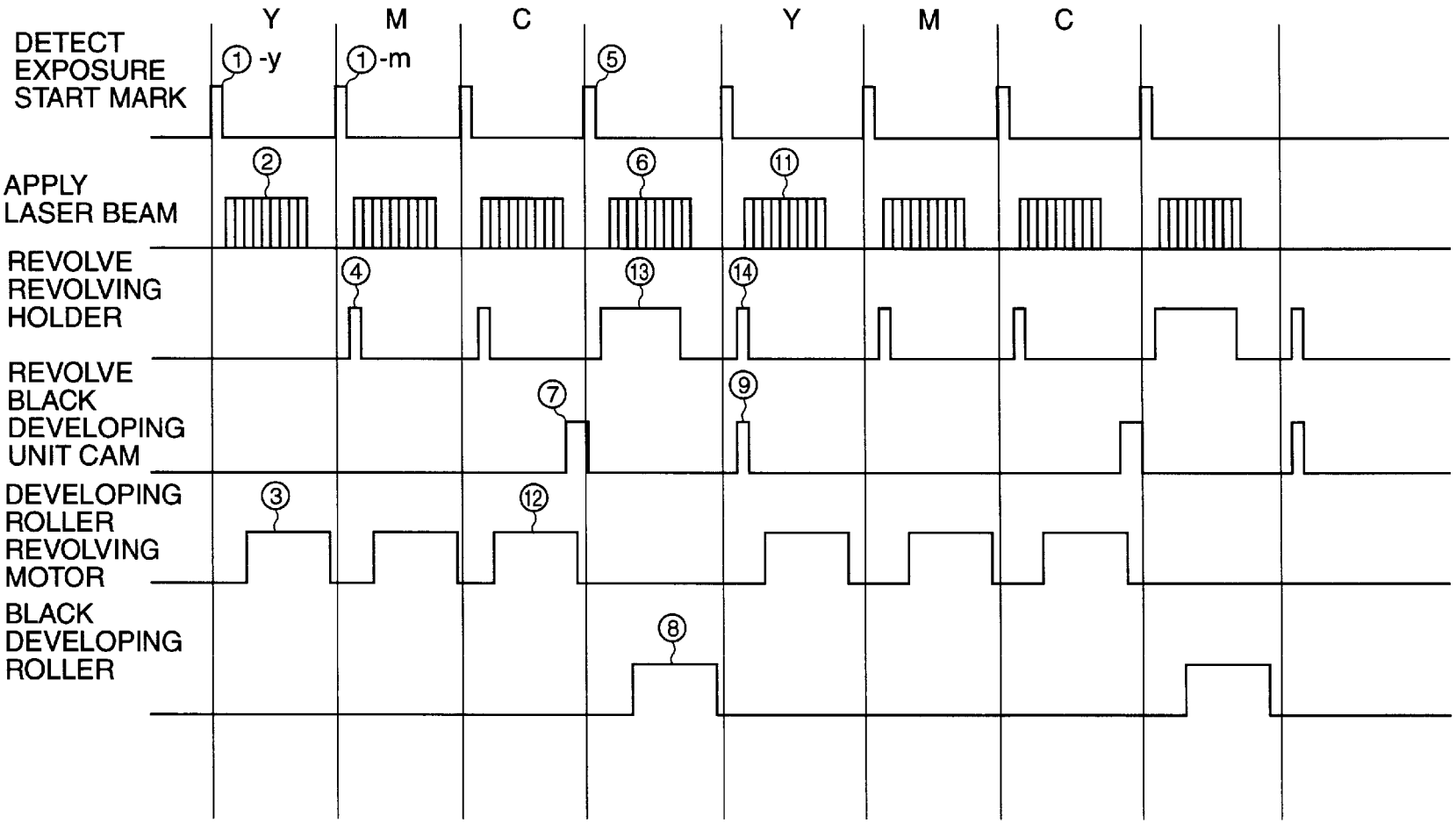
FIG. 12 is a timing chart showing the developing process in a first modified example of this invention.
Figure 13:
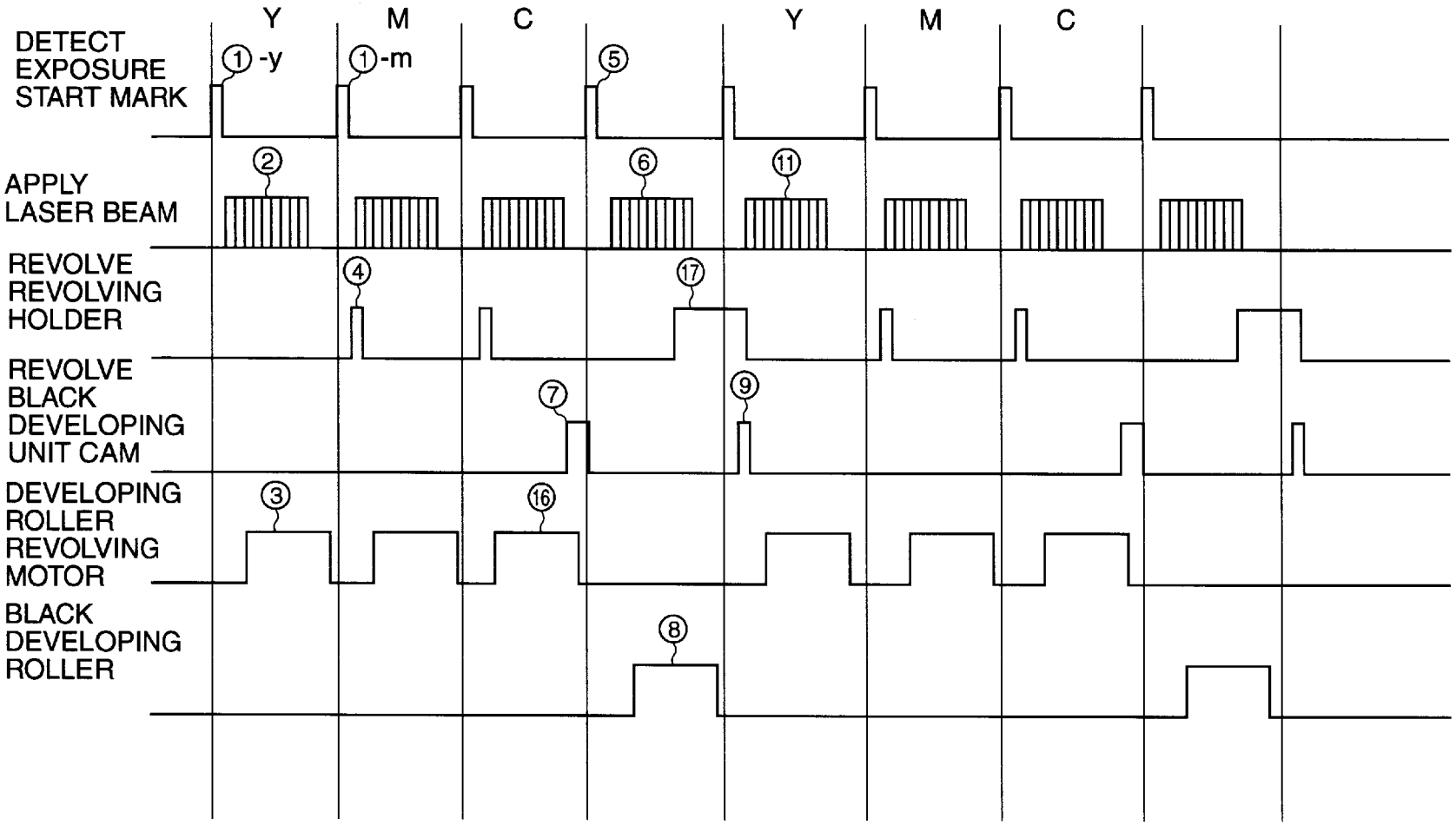
FIG. 13 is a timing chart showing the developing process in a second modified example of this invention.

For example, as a first modified example, in the above embodiment, after completing the development of the cyan toner image at the timing (12) as shown in the timing chart in FIG. 12, the 3-color revolver type developing unit 20 may be revolved for a specified time at the timing (13) and then, once stopped to revolve and again revolved at the timing (14) immediately before starting the development of an yellow toner image and the first developing unit 16 may be moved to the developing position. Thus, when the 3-color revolver type developing unit 20 is revolved by dividing into two times and again revolved immediately before starting the development of an yellow toner image so that the first developing unit 16 reaches the developing position, it is possible to prevent a black toner image from being disturbed by the contact with the first developing roller 16*a*.

Further, as a second modified example, in the above embodiment, the disturbance of a black toner image caused by contact with the first developing roller 16*a* can be prevented by starting the revolving holder 37 to revolve after waiting a specified time as shown by the timing (17) after completing the development of a cyan toner image as shown by the timing (16) so that the first developing unit 16 reaches the developing position immediately before starting the development of an yellow toner image.

Figure 14:
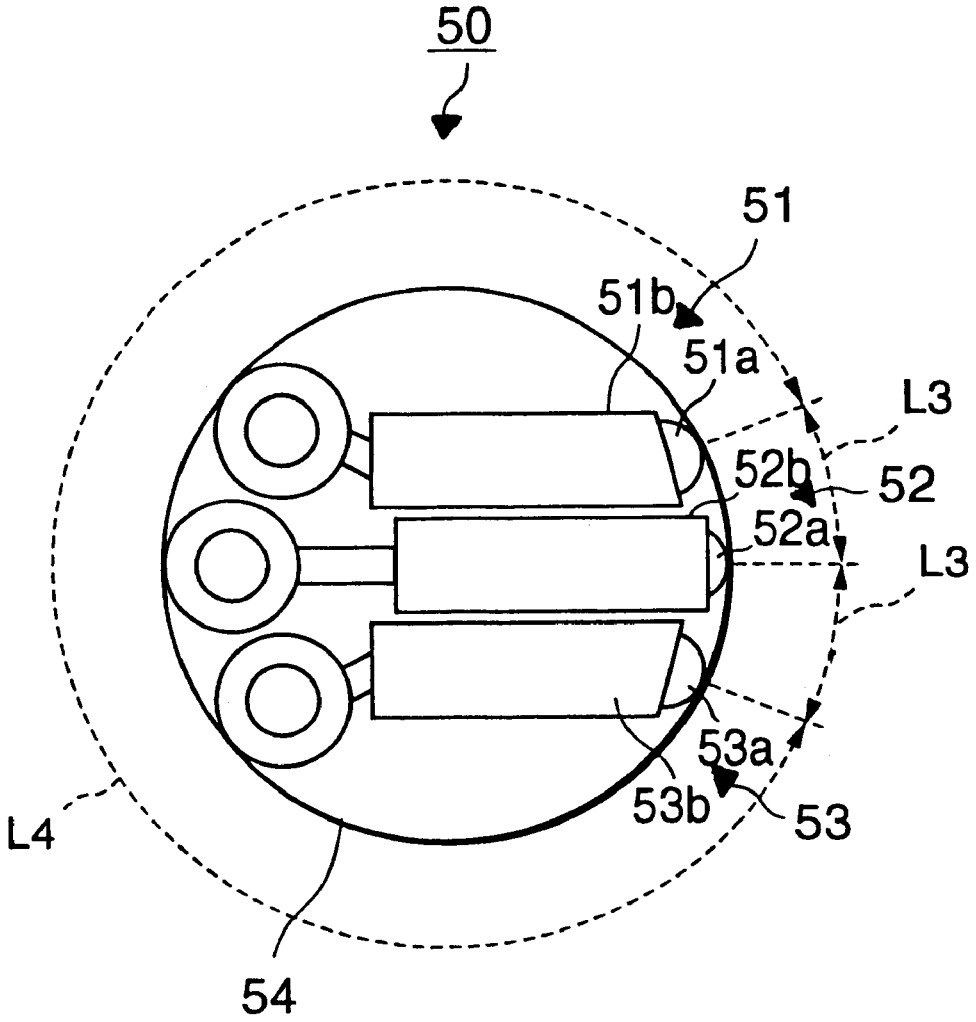
FIG. 14 is a schematic structural diagram showing the 3-color revolver type developing unit in the second modified example of this invention.

Further, the structure of the revolving type developing device is also optional as shown in FIG. 14 as a third modified example. Fourth-through sixth developing units 51–53 includes fourth through sixth developing cartridges 51*b*–53*b* having yellow (Y), magenta (M), cyan (C) toners, respectively and fourth through sixth developing rollers 51*a*–53*a*. The fourth through sixth developing cartridges 51*b*–53*b* may be arranged in parallel with each other in a 3-color revolver type developing unit 50. The fourth through sixth developing rollers 51*a*–53*a* may be arranged consecutively at an equal space of L3 along the circumference 54. On the other hand, the sixth developing roller 53*a* and the fourth developing roller 51*a* may be set at an equal space of L4 which is longer than L3.

As described above in detail, according to this invention, the developing units of a revolving type developing device equipped with plural color developing units only except a black developing unit are arranged consecutively at a first distance and the developing unit at the rearmost part in the revolving direction, the developing unit at the foremost part are arranged at a second distance which is longer than the first distance. Thus, the first distance is set short and a time required for switching color developing units separated at the first distance can be made short. Accordingly, it is not necessary to use a large driving motor or a large power source for revolving the revolving type developing device and a small-sized and energy saving image forming apparatus for extending the life of the black developing device without impeding a high speed quality can be obtained.

Further, in the area separated by the second distance, a time is needed for switching color image developing devices; however, during this time interval, the development by the black developing device is made and therefore, there is no possibility for decreasing the image forming process speed. Further, since it is not necessary to revolve the revolving type image developing device at a high speed, vibration generated when stopping the revolving type image developing device can be reduced and the image quality can be improved.

What is claimed is:

1. An image forming apparatus comprising:

an image carrier;

a latent image forming unit to form latent images on the image carrier;

a black developing unit arranged near the image carrier to supply a black developer to the image carrier; and a revolver type developing unit arranged at a position near the image carrier and differing from the black developing unit, comprising developing rollers of plural color developing units which have different color developers arranged at an equal space of a first distance along the circumference of a revolving body in contact with the image carrier, wherein a developing unit at the last part in the revolving direction of the revolving body and a developing unit at the foremost part in the revolving direction are separated at a second distance longer than the first distance, and anyone of the plural color developing units is arranged opposing to the image carrier and supply a respective color developer; wherein an area from the developing unit at the last part of the revolver type developing device to the foremost developing unit separated by the second distance opposing to the image carrier, a black developer is supplied to the image carrier by the black developing unit.

2. An image forming apparatus according to claim 1, wherein when moving the developing rollers of the plural color developing units to the positions opposite to the image carrier, the revolving body is revolved at equal velocity until reaching the color developing device at the last part in the revolving direction from the color developing device at the foremost part in the revolving direction of the revolving body.

3. An image forming apparatus according to claim 2, wherein when moving the developing rollers of the plural developing units to the positions opposite to the image carrier, the revolving body is revolved at a slower velocity than the equal velocity until reaching the color developing unit at the foremost part in the revolving direction from the color developing unit at the last part in the revolving direction of the revolving body.

4. An image forming apparatus according to claim 2, wherein when moving the developing rollers of the plural color developing units to the positions opposite to the image carrier, the revolving body is revolved a plural number of revolutions until reaching the color developing unit at the foremost part in the revolving direction from the color developing unit at the last part in the revolving direction of the revolving body.

5. An image forming apparatus according to claim 2, wherein when moving the developing rollers of the plural color developing units to the positions opposite to the image carrier, the revolving body is started to revolve after a specified time is elapsed until reaching the color developing unit at the foremost part in the revolving direction from the color developing unit at the last part in the revolving direction of the revolving body.

6. An image forming apparatus according to claim 1, wherein the plural color developing units have toner supply units and the plural color developing units and the toner supply units are arranged to oppose to each other centering around a revolving shaft of the revolving body.

7. An image forming apparatus according to claim 6, wherein the plural color developing units adjacent to each other from the developing unit at the foremost part in the revolving direction of the revolving body to the developing unit at the last part in the revolving direction are arranged at an equal space of 30°.

8. An image forming apparatus according to claim 1, wherein the plural color developing units are first, second and third developing devices having yellow (Y), cyan (C) and magenta (M) toner, respectively.

9. An image forming apparatus according to claim 1, wherein there is an intermediate transfer device to which a developed image formed on the image carrier by the black developing unit and the revolver type developing unit is primarily transferred and transfers the primarily transferred developed image on a transfer material secondarily.

10. An image forming apparatus comprising:

an image carrier;

a latent image forming unit to form a latent image on the image carrier;

a black developing unit arranged near the image carrier to supply black developer to the image carrier; and a revolver type developing unit arranged at a position near the image carrier and differing from the black developing unit, comprising developing rollers of plural color developing units which have different color developers arranged at an equal space of a first distance along the circumference of a revolving body in contact with the image carrier of a revolving holder wherein a developing roller at the last part in the revolving direction of the revolving holder to a developing roller at the foremost part in the revolving direction are separated at a second distance longer than the first distance, and anyone of the developing rollers is arranged to oppose to the image carrier and supply color developer; and wherein an area from the developing roller at the last part of the revolving-type developing unit to the developing roller at the foremost part separated by the second distance opposing to the image carrier, a black developer is supplied to the image carrier by the black developing unit.

11. An image forming apparatus according to claim 10, wherein when the developing rollers of the plural color developing units are moved to the positions opposite to the image carrier, the revolving holder is revolved at an equal velocity until reaching the color developing unit at the last part in the revolving direction from the color developing unit at the foremost part in the revolving direction of the revolving holder.

12. An image forming apparatus according to claim 11, wherein when moving the developing rollers of the plural color developing units to the positions opposite to the image carrier, the revolving holder is revolved at a velocity slower than an equal revolving velocity until reaching the developing unit at a foremost portion in the revolving direction from the developing unit at a last portion in the revolving direction of the revolving holder.

13. An image forming apparatus according to claim 11, wherein when moving the developing rollers of the plural color developing units to the positions opposite to the image carrier, the revolving holder is revolved a plural number of times until reaching the developing roller at a foremost portion in the revolving direction from the developing unit at a last portion in the revolving direction of the revolving holder.

14. An image forming apparatus according to claim 11, wherein when moving the developing rollers of the plural color developing units to the positions opposite to the image carrier, the revolving holder starts to revolve after a specified time is elapsed until reaching the developing unit at a foremost portion in the revolving direction from the developing unit at a last portion in the revolving direction of the revolving holder.

15. An image forming apparatus according to claim 10, wherein the plural color developing units have a toner cartridges, and the developing roller and the toner cartridges are arranged to oppose to the center of a revolving shaft of the revolving holder for every developing unit.

16. An image forming apparatus according to claim 15, wherein adjacent developing units are spaced equally by 30° until reaching the developing unit at a last portion in the revolving direction from the developing unit at a foremost portion in the revolving direction of the revolving holder.

17. An image forming apparatus according to claim 10, wherein the plural color developing units are first, second and third developing units having yellow (Y), cyan (C) and magenta (M) toners, respectively.

18. An image forming apparatus according to claim 10, wherein an intermediate transfer device to which a developed image formed on the image carrier is primarily transferred by the black developing unit and the revolver type developing unit, and secondarily transferred on a transfer material.

19. An image forming apparatus according to claim 18, wherein the image carrier is a photosensitive drum and the intermediate transfer device is an intermediate transfer belt.

* * * * *